US005193666A

United States Patent [19]

Markowski et al.

[11] Patent Number: 5,193,666

[45] Date of Patent: Mar. 16, 1993

[54] HANDLE EXTENDER FOR MOLDED CASE CIRCUIT BREAKER ACTUATOR MECHANISM

[75] Inventors: Robert G. Markowski, East Haven; Dean A. Robarge, New Britain, both of Conn.; Jerome B. Tankersley, III, Fredericksburg, Va.

[73] Assignee: General Electric Company, New York, N.Y.

[21] Appl. No.: 751,451

[22] Filed: Aug. 28, 1991

[51] Int. Cl.[5] ..... H01H 3/20

[52] U.S. Cl. ..... 200/331; 200/337; 16/115; 74/544; 74/546

[58] Field of Search ..... 200/329, 330, 331, 332, 200/335, 336, 337, 338; 16/110 R, 115; 74/543, 544, 546, 551.2, 551.3, 545, 547; 294/57, 58; 174/46; 361/391; 49/460; 312/320; 150/108; 190/39, 115, 117; 15/410, 411

[56] References Cited

U.S. PATENT DOCUMENTS

| | | | |
|---|---|---|---|
| 524,522 | 8/1894 | Bourne | 74/546 |
| 2,260,785 | 10/1941 | Miguel | 16/115 |
| 2,723,329 | 11/1955 | Baird | 200/330 |
| 3,011,362 | 12/1961 | Cronholm | 74/546 |
| 3,142,744 | 7/1964 | Keck | 200/331 |
| 3,153,252 | 10/1964 | Ricciardi | 16/115 |
| 3,272,953 | 9/1966 | Tillson | 200/330 |
| 3,606,193 | 9/1971 | Allred | 74/546 X |
| 3,821,532 | 6/1974 | Isaac, Jr. et al. | 200/330 |
| 4,115,669 | 9/1978 | Cali | 200/331 |
| 4,300,027 | 11/1981 | Rask et al. | 200/330 X |
| 4,308,441 | 12/1981 | Evans et al. | 200/335 |
| 4,598,183 | 7/1986 | Gardner et al. | 200/330 X |
| 4,615,553 | 10/1986 | Hultine | 294/58 |
| 4,620,077 | 10/1986 | Zdanys et al. | 200/331 |
| 4,621,876 | 11/1986 | Reimer | 312/320 X |
| 4,626,638 | 12/1986 | Samples et al. | 200/331 |
| 4,789,919 | 12/1988 | Cox et al. | 361/391 X |
| 4,873,404 | 10/1989 | Fritsch | 200/337 |
| 4,945,450 | 7/1990 | Sabatella et al. | 361/334 |
| 5,049,846 | 9/1991 | Morgan et al. | 200/329 X |

OTHER PUBLICATIONS

Serial No. 561,760 entitled "Molded Case Circuit Breaker Variable Actuator Mechanism", filed Aug. 2, 1990, Robarge et al.

*Primary Examiner*—Henry J. Recla
*Assistant Examiner*—Glenn T. Barrett
*Attorney, Agent, or Firm*—Richard A. Menelly

[57] ABSTRACT

A remote actuator for an enclosed molded case circuit breaker or disconnect switch utilizes an actuator cable connection with the circuit breaker operating handle in a "pull-pull" arrangement. The cable is arranged in an endless loop between the actuator handle and the circuit breaker operating handle. Moving the actuator handle in a first direction pulls the circuit breaker operating handle to its ON position while moving the actuator handle in an opposite direction pulls the circuit breaker operating handle to its OFF positoin. A retractable handle extender on the actuator handle increases the torquing force applied to the actuator handle and the circuit breaker operating handle.

6 Claims, 3 Drawing Sheets

HANDLE EXTENDER FOR MOLDED CASE CIRCUIT BREAKER ACTUATOR MECHANISM

BACKGROUND OF THE INVENTION

U.S. Pat. No. 4,945,450 entitled "Modular Electric Switch-Circuit Breaker Assembly" describes a switchboard used within an industrial electrical power distribution system. A plurality of switches and circuit breakers are mounted within the interior of the switchboard. When a molded case circuit breaker is mounted within the switchboard interior, an externally-accessible actuator handle is required to move the circuit breaker operating handle between its ON and OFF positions. One operating system for remote electrical equipment which uses a flexible push-pull type cable to connect between the actuator handle and the circuit breaker handle is described within U.S. Pat. No. 4,626,638.

The aforementioned U.S. Pat. No. 4,626,638, requires a mechanical linkage interposed between the operating handle and the cable to affect the push-pull relationship between the actuator handle and the circuit breaker operating handle.

Circuit breaker operating mechanisms utilizing powerful overcentered springs to hold the circuit breaker contacts in their closed conditions often require a handle extender to increase the opening and closing forces required to move the springs between their over-centered open and closed positions. U.S. Pat. No. 3,821,532 describes a handle extension assembly used to increase the opening and closing forces applied to a molded case circuit breaker operating handle. Rudimentary extenders for electric switches, circuit breakers, shovels and the like are disclosed within U.S. Pat. Nos. 2,723,329; 3,142,744; 4,115,669 and 4,615,553.

When such molded case Circuit breakers are enclosed within electrical equipment enclosures requiring an externally accessible actuator mechanism of the type described in U.S. patent application Ser. No. 561,760 filed Aug. 2, 1990 entitled "Molded Case Circuit Breaker Variable Actuator Mechanism", such circuit breaker handle extenders are no longer feasible.

One purpose of this invention is to provide an actuator mechanism which includes a direct connection between the actuator handle and the cable as well as between the circuit breaker and the cable in an endless loop configuration without requiring any intervening mechanical linkage assembly. A further purpose of the invention is to provide increased closing and opening force to the actuator handle and the circuit breaker operating handle by means of an actuator handle extender.

SUMMARY OF THE INVENTION

A circuit breaker actuator mechanism allows a molded case circuit breaker contained within an enclosure to be turned ON and OFF from outside the enclosure by means of a cable connection between the circuit breaker operating handle and the externally accessible actuator handle in an endless loop. The endless loop allows the actuator handle to associate with the circuit breaker handle in a pull-pull arrangement whereby the circuit breaker operating handle is pulled both to its ON and its OFF positions. A retractable actuator handle extender applies increased opening and closing forces to the actuator handle which, in turn, is transmitted to the circuit breaker operating handle by means of the cable connection.

DESCRIPTION OF THE PREFERRED EMBODIMENT

Figure 1:
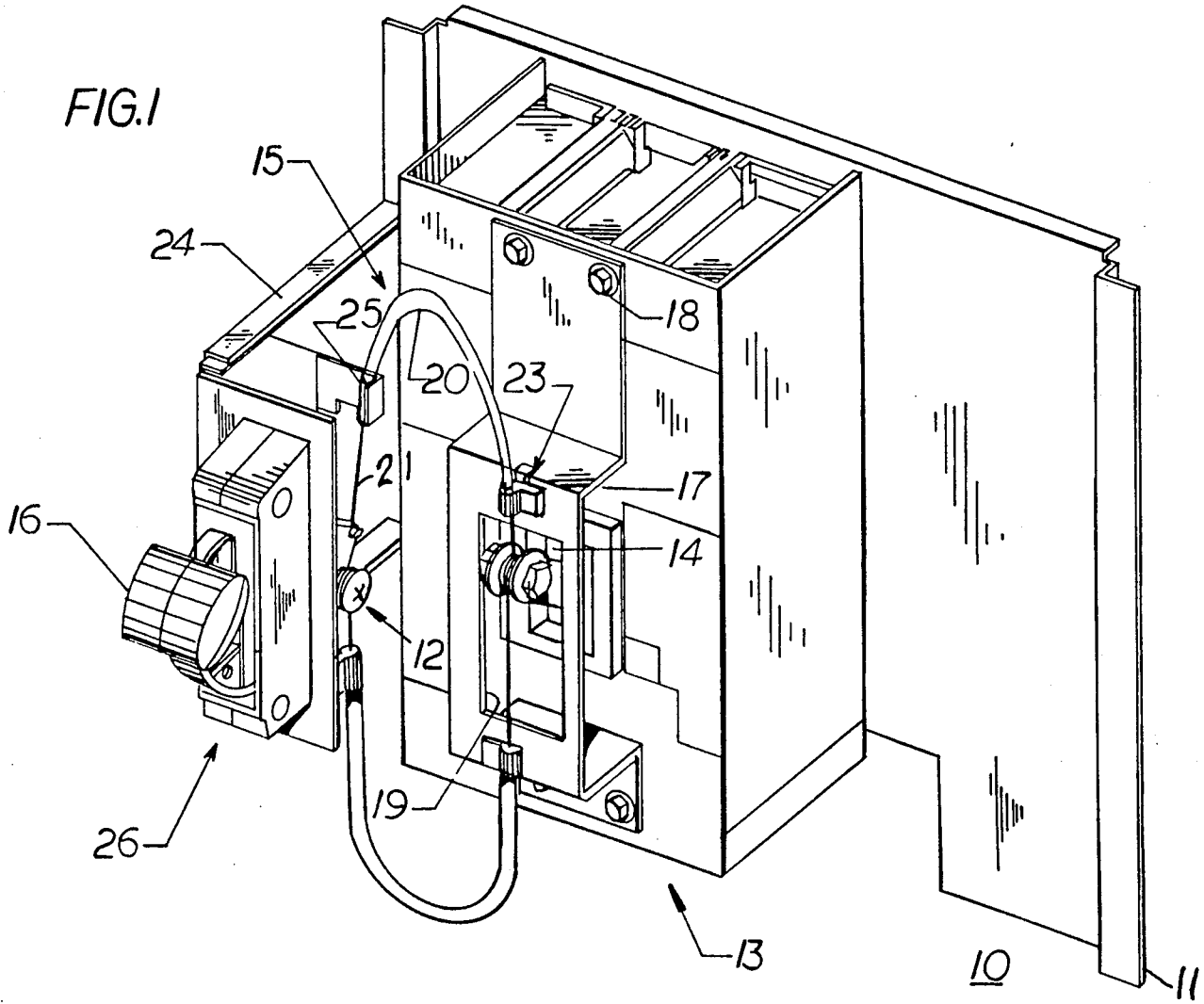
FIG. 1 is a front perspective view of a circuit breaker enclosure including the variable actuator mechanism and actuator handle extender in accordance with the invention.

An enclosed disconnect switch or enclosed circuit breaker 10 is shown in FIG. 1 wherein the circuit breaker 13 is mounted within a modular enclosure 11. In order to operate the circuit breaker from the exterior of the enclosure, an actuator mechanism 12 is operatably connected with the circuit breaker operating handle 14 by means of an endless cable 15 that runs between the circuit breaker operating handle and the actuator mechanism handle 16. The actuator mechanism includes a stepped support platform 17 that attaches directly to the circuit breaker by means of bolts 18, as indicated. The circuit breaker operating handle extends upwards through a rectangular aperture 19 formed in the support platform and the cable is attached to the platform at opposite ends of the aperture. The cable comprises an outer insulative sheath 20 and an inner flexible wire 21 where the wire is connected to the circuit breaker operating handle by a U-shaped plate in the manner described within U.S. patent application Ser. No. 561,760 filed Aug. 2, 1990 entitled "Molded Case Circuit Breaker Variable Actuator Mechanism". The cable sheath is attached to the platform at opposite sides of the rectangular aperture by means of a pair of cable clamps 23. The attachment of the cable sheath to the platform allows the flexible wire 21 to reciprocate between the circuit breaker operating handle and the actuator mechanism handle in an endless loop. The actuator mechanism is attached to the modular enclosure 11 by means of the upstanding plate 24 which also supports the opposite ends of the cable 15 by means of a pair of corresponding cable clamps 25.

Figure 2:
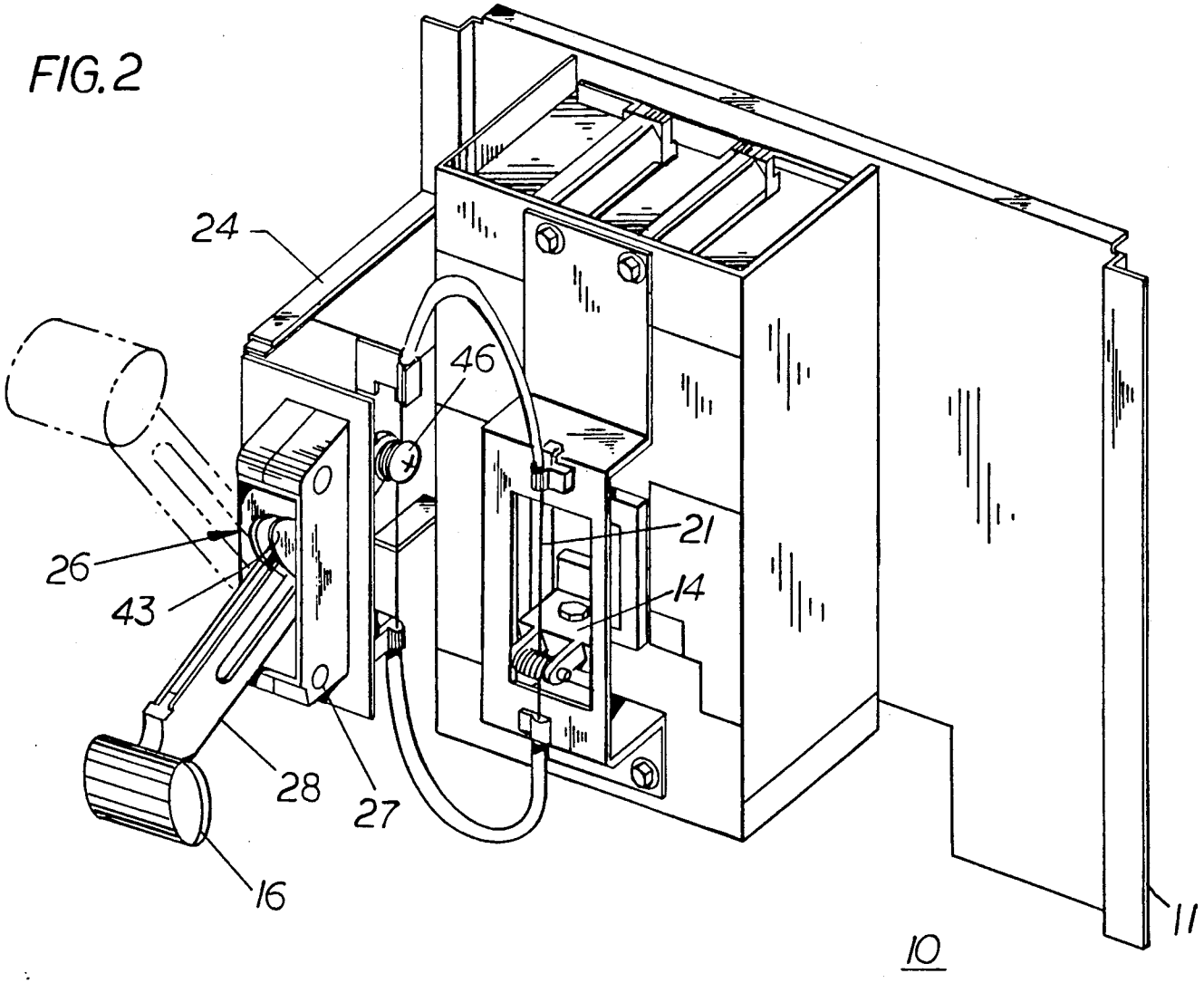
FIG. 2 is a front perspective view of the enclosure of FIG. 1 with the actuator handle in an extended position.

When it is desired to operate the actuator handle extender 26 to open and close the contacts within the enclosed circuit breaker 10, the actuator handle 16 is first extended to provide additional torquing to the circuit breaker operating handle 14 as shown in FIG. 2. The actuator mechanism handle 16 is attached to the end of an extender rail 28 which provides additional length to the actuator mechanism handle such that when rotate in the clockwise direction, as indicated in phantom, an increased torque is exerted upon the wire 21 which connects with the end of the rail by means of bolt 46 and thereby to the circuit breaker operating handle 14. The extender rail rotates freely between the pair of outer radial guides 43 that are connected within the actuator handle extender housing 27 which is attached to the enclosure 11 by means of the upstanding plate 24.

Figure 3:
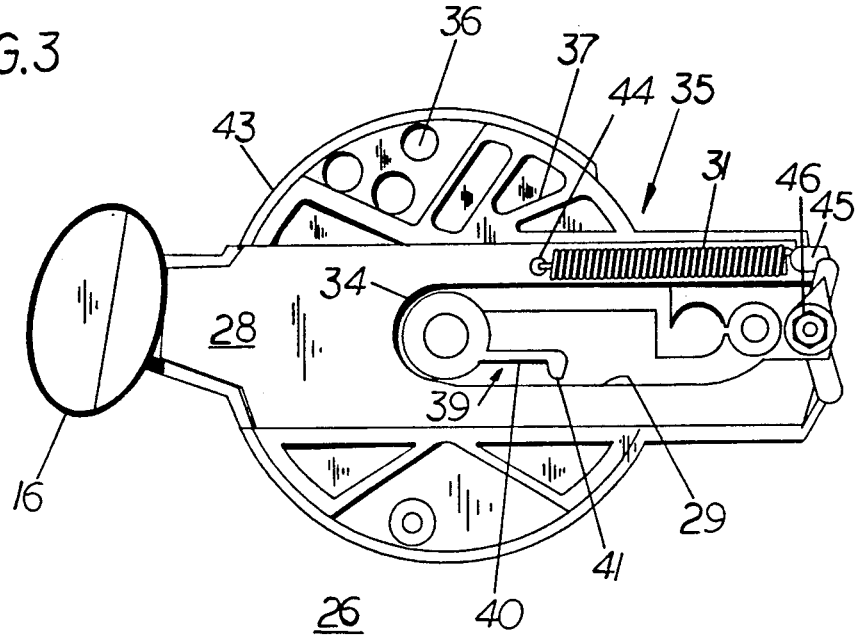
FIG. 3 is an enlarged side view of the actuator handle of FIGS. 1 and 2 in an retracted position.

The actuator handle extender 26 is shown in FIG. 3 with the housing and one of the outer radial guides 43 removed to show the extender rail 28 trapped within the linear guideway 35 captured between the top and bottom halves of the outer radial guide. The roller guide 34 centrally positioned on the outer radial guide 43 (FIG. 4) supports the extender rail 28 by means of the slot 29 wherein the roller guide is captured. The extension spring 31 connects to the extender rail 28, at one end as indicated at 44, and to the linear end of the radial guide 43 at the other end a indicated at 45 and biases the extender rail within the housing. To prevent the actuator mechanism handle 16 and extender rail 28 from returning under the bias of the extension spring 31 when extended, a detent 39 consisting of an extended arm 40 and a radial end 41 is positioned next to the extender rail slot 29. The upstanding ribs 37 integrally formed within the sides of the outer radial guides 43 provide additional strength to the housing and the apertures 36, on the top and bottom halves of the outer radial guide allow the provision of a padlock to lock the actuator mechanism handle in the open or closed positions.

Figure 4:
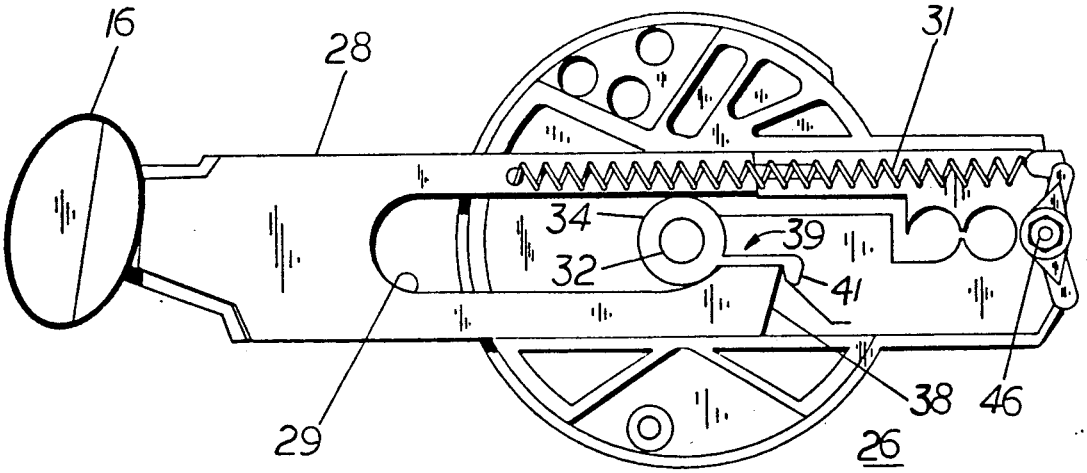
FIG. 4 is an enlarged side view of the actuator handle in a extended position.

When the actuator mechanism handle 16 on the actuator handle extender 26 is extended, as indicated in FIG. 4, the extender rail 28 moves outward from the roller guide 34 by means of the slot 29, as described earlier. The extension spring 31 provides return bias to the actuator mechanism handle 16 and to the extender rail 28 which is prevented from returning to the rest position of FIG. 3 by the capture between the radial end 41 of the detent 39 and the slanted end 38 of the extender rail 28. The cable wire 21 (FIG. 2) connects with the end of the outer guideway by means of the bolt 46 such that when the actuator mechanism handle 16 is rotated in the clockwise or counterclockwise direction about the central pivot pin 32, the added torque is applied to the cable wire by connection therewith.

Having thus described our invention, what we claim as new and desire to secure by Letters Patent is:

We claim:

1. A handle extender comprising:

a housing;

an extender rail having opposite sides displacedly positioned within said housing on a roller guide and having a cable wire attached to one end;

an access handle on one end of said rail external said housing adapted for manually displacing said rail from said housing;

an extension spring connecting with said rail for returning said rail back within said housing;

said rail pivoting about said roller guide;

said rail including a longitudinal slot, said roller guide being arranged within said longitudinal slot; and a linear guideway arranged on said opposite sides of said rail, said linear guideway providing outer support to said extender rails, an opposite end of said cable wire being attached to a circuit breaker or electric switch operating handle.

2. The handle extender of claim 1 wherein said linear guide means includes apertures arranged for receiving a padlock.

3. The handle extender of claim 1 wherein an opposite end of said cable wire is attached to said linear guide means.

4. The handle extender of claim 1 including radial guide means within said housing on opposite sides of said linear guide way providing outer support to said linear guide way and said extender rail.

5. A handle extender comprising:

a housing;

an extender rail displacedly positioned within said housing on a roller guide;

an access handle on one end of said rail external said housing adapted for manually displacing said rail from said housing;

an extension spring connecting with said rail for returning said rail back within said housing; and detent means arranged within said housing for interacting with said rail to prevent said rail from returning within said housing under return bias provided by said extension spring, said detent means comprising an elongated arm attached to said housing at one end and terminating in a radius at an opposite end thereof.

6. The handle extender of claim 5 wherein said roller guide is supported within said housing upon a pivot pin.

* * * * *